US008931526B2

(12) United States Patent
Clüsserath

(10) Patent No.: US 8,931,526 B2
(45) Date of Patent: Jan. 13, 2015

(54) FILLING ELEMENT

(75) Inventor: Ludwig Clüsserath, Bad Kreuznach (DE)

(73) Assignee: KHS GmbH, Dortmund (DE)

( * ) Notice: Subject to any disclaimer, the term of this patent is extended or adjusted under 35 U.S.C. 154(b) by 286 days.

(21) Appl. No.: 13/498,634

(22) PCT Filed: Oct. 8, 2010

(86) PCT No.: PCT/EP2010/006166
§ 371 (c)(1),
(2), (4) Date: Mar. 28, 2012

(87) PCT Pub. No.: WO2011/060853
PCT Pub. Date: May 26, 2011

(65) Prior Publication Data

US 2012/0186695 A1 Jul. 26, 2012

(30) Foreign Application Priority Data

Nov. 17, 2009 (DE) ..... 10 2009 053 350

(51) Int. Cl.
*B65B 3/04* (2006.01)
*B67C 3/02* (2006.01)
*B67C 3/26* (2006.01)

(52) U.S. Cl.
CPC *B67C 3/2608* (2013.01); *B65B 3/04* (2013.01)
USPC ..... 141/311 A; 141/91; 141/392

(58) Field of Classification Search
CPC ..... B65B 3/04; B67C 3/02; B67C 3/26; B67C 3/2608
USPC ..... 141/89–91, 311 A, 392
See application file for complete search history.

(56) References Cited

U.S. PATENT DOCUMENTS

| | | | | |
|---|---|---|---|---|
| 2,321,017 | A | 6/1943 | De La Calle | |
| 3,635,263 | A | 1/1972 | Jordon | |
| 7,308,917 | B2 | 12/2007 | Krulitsch | |
| 8,459,311 | B2 * | 6/2013 | Green | 141/3 |
| 8,505,594 | B2 * | 8/2013 | Krulitsch | 141/104 |
| 8,590,581 | B2 * | 11/2013 | Clusserath | 141/9 |
| 2006/0289078 | A1 * | 12/2006 | Wingens et al. | 141/57 |
| 2009/0095370 | A1 * | 4/2009 | Krulitsch | 141/6 |
| 2009/0293985 | A1 * | 12/2009 | Till et al. | 141/1 |
| 2013/0074979 | A1 * | 3/2013 | Krulitsch | 141/5 |

FOREIGN PATENT DOCUMENTS

| | | |
|---|---|---|
| DE | 1782642 | 3/1972 |
| DE | 102004013211 | 9/2005 |
| DE | 102006001178 | 7/2007 |
| EP | 1698558 | 9/2006 |
| WO | 2007/137727 | 12/2007 |

* cited by examiner

*Primary Examiner* — Nicolas A Arnett
(74) *Attorney, Agent, or Firm* — Occhiuti & Rohlicek LLP

(57) ABSTRACT

The invention relates to a filling element for a filling system or for a filling machine for filling containers with a liquid filling material. The filling element has at least one liquid channel designed in a filling element housing, which channel forms at least one discharge opening for the liquid filling material and can be connected to a source for providing the liquid filling material or a component of said filling material, at least one liquid valve in the at least one liquid channel for the controlled discharge of the filling material or the component at the discharge opening, and a gas barrier, which, when the liquid valve is closed, prevents the filling material from continuing to flow or drip, and for that purpose forms at least one flow channel having a reduced cross-section.

23 Claims, 3 Drawing Sheets

FILLING ELEMENT

CROSS REFERENCE TO RELATED APPLICATIONS

This application is the national stage application of international application no. PCT/EP2010/006166, filed on Oct. 8, 2010, which claims priority to German application no. 10 2009 053 350.8, filed on Nov. 17, 2009. The contents of the aforementioned applications are incorporated herewith.

FIELD OF INVENTION

The invention relates to a filling containers, and in particular, to filling containers with a liquid having suspended solids.

BACKGROUND

Filling elements for filling machines are known in various different embodiments and consist essentially of a filling element housing having at least one liquid channel that is connected to a tank for providing the liquid product or filling material, or a component of this product or filling material, and at least one discharge opening for the controlled dispensing of the filling material into the container to be filled (e.g. into a bottle) as a function of the activation of a filling or liquid valve disposed in the liquid channel.

In particular it is known for filling elements to be provided at their discharge opening, or in the direction of flow of the filling material before the discharge opening, with gas barriers that, after the end of the particular filling operation and after the liquid valve closes, prevent the filling material from continuing to flow or drip from a partial space of the filling element, the partial space being formed by a section of the liquid channel downstream of the liquid valve in the direction of flow of the filling material.

With known filling elements, these gas barriers are usually executed as strainer-like inserts forming a plurality of strainer or flow channels for the liquid filling material, with the number and size of individual surfaces of the cross-sections of the flow channels being selected so that, when the liquid valve is closed, the filling material is held back in the partial section of the liquid channel by its surface tension in interaction with the ambient pressure. As a result, filling material does not continue to flow or drip through the gas barrier.

All known gas barriers have the disadvantage that they clog up frequently during the filling of products, for example drinks, that have solid constituents or suspended solids, such as pulps, fibers (including fruit fibers) etc. This is due, among other things, to the fact that the strainer-like structure necessarily forms webs or surfaces or structures that run square to the direction of flow or main direction of flow of the filling material and on which more solid constituents (solids, such as pulp, fibers including fruit fibers etc.) become lodged. This disadvantage is particularly noticeable when the filling material contains very long fibers that wrap themselves around, for example, the cross-webs formed by the strainer-like structure, thereby very rapidly constricting the flow cross-section of the gas barrier that is in use, and ultimately blocking it. Consequently the known gas barriers only permit the reliable processing of products with small solid particles.

SUMMARY

The task of the invention is to propose a filling element that avoids this disadvantage.

In the inventive filling element, the gas barrier associated with the at least one liquid channel is formed by at least one rod-shaped element.

The rod-shaped element reaches into the section of the liquid channel that forms the gas barrier ("second" section) and/or into the discharge opening and only partly occupies the cross-section of this section and/or of the discharge opening so that a gap forming a flow channel of the gas barrier is left between the rod-shaped element and the inner surface of the section or discharge opening.

In a preferred embodiment the gas barrier is formed by a plurality or bundle of rod-shaped elements that also reach into the second section of the liquid channel and/or into the discharge opening and are also spaced apart from one another to form flow channels for the gas barrier.

The cross-section of the rod-shaped element and/or the total cross-section (sum of the cross-sections of the elements of the bundle) is for example selected so that this cross-section or total cross-section occupies at least 50% of the inside cross-section of the second section and/or of the discharge opening, and/or that the cross-section of each flow channel of the gas barrier is several times smaller than the effective cross-section of one of the sections of the liquid channel preceding the gas barrier in the direction of flow of the filling material ("first" section). In some embodiments, the cross-section of each flow channel of the gas barrier is only 3% to 10% of the cross-section of the first section.

Whatever the number of rod-shaped, gas barrier-forming elements, the particularity of the invention is that the rod-shaped element or rod-shaped elements also extend inside the first section of the liquid channel that is in the direction of flow of the filling material comes before the gas barrier and after the liquid valve. Consequently the solids present in the filling material such as pulp, fibers including fruit fibers etc. encounter no surfaces, regions or structures in the flow path of the filling material between the liquid valve and the discharge opening and in particular in this first section of the liquid channel and at the transition to the gas barrier that are oriented square to the main the direction of flow of the filling material and on which solid constituents can be deposited.

Further embodiments, advantages and possible applications of the invention arise out of the following description of embodiments and out of the figures. All of the described and/or pictorially represented attributes whether alone or in any desired combination are fundamentally the subject matter of the invention independently of their synopsis in the claims or a retroactive application thereof. The content of the claims is also made an integral part of the description.

The invention is explained hereinbelow by reference to the figures that show in simplified depiction a partial section through a filling element for filling a liquid filling material or product into containers in the form of bottles.

DETAILED DESCRIPTION

Figure 1:
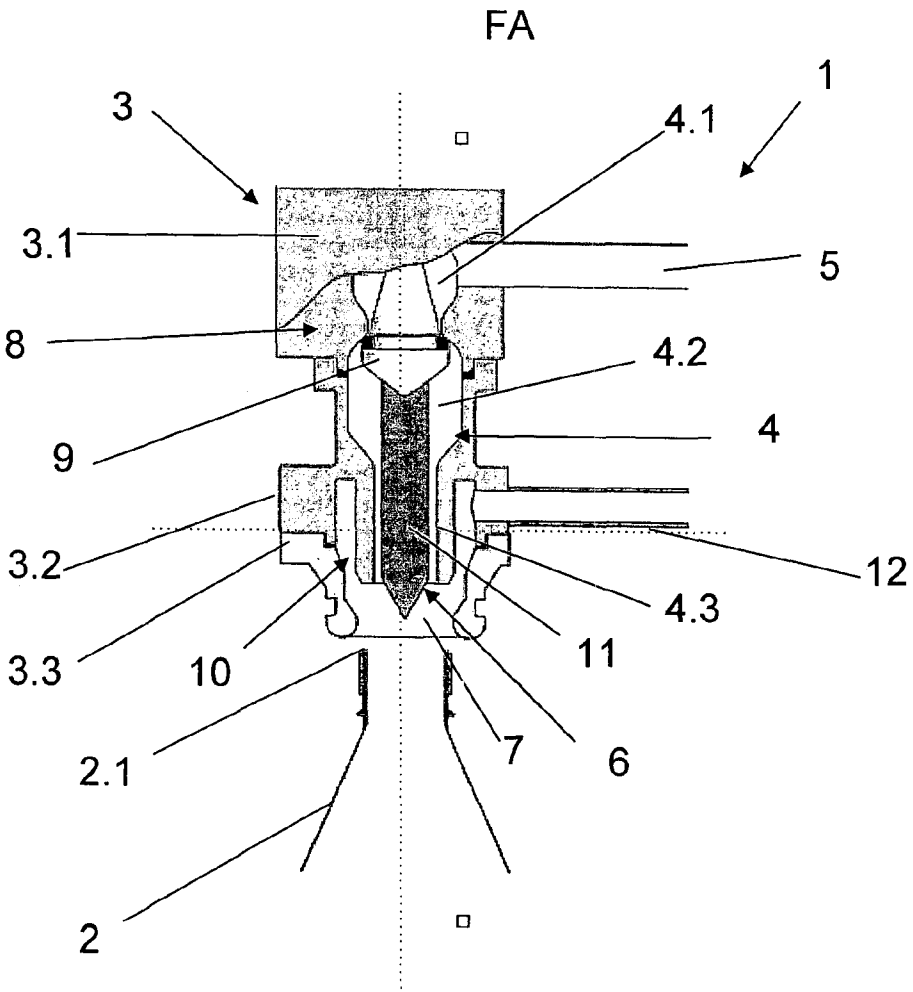
FIG. 1 shows a filling element used for open-jet filling.

Referring to FIG. 1, a filling element 1 is used for the open-jet filling of containers in the form of bottles 2 that during the filling operation are arranged with their bottle opening or bottle mouth 2.1 at a distance below filling element 1, and with their bottle axis on the same axis as a vertical filling element axis FA, such that the filling material can flow into the bottle 2 in an open vertically oriented jet through bottle mouth 2.1.

The filling element 1 comprises a filling element housing 3 that in the depicted embodiment is configured in at least three parts, these being an upper housing part 3.1, a middle housing part 3.2 adjoining the latter in the direction of filling element axis FA, and an annular lower housing part 3.3. A liquid channel 4 for the liquid filling material is configured in the upper housing part 3.1 and the annular lower housing part 3.3.

The upper end of the liquid channel 4 is connected by a filling material line 5 to a container or tank provided on the filling material machine for delivering the liquid filling material. The lower end of the liquid channel 4 is open and forms a discharge opening 6 that, in the depicted embodiment, the discharge opening 6 is annular and located inside a space 7 that is formed by the annular lower housing part 3.3, and at an axial distance from the lower open end of the annular housing part 3.3.

A liquid valve 8 having a valve body 9 configured on a valve stem is provided in the liquid channel 4 for the controlled discharge of the filling material into a bottle 2. The liquid valve 8 interacts with a valve face on the inner surface of liquid channel 4 and is moved through a given stroke on the filling element axis FA to open and close the liquid valve 8. In the depicted embodiment, the liquid valve 8 is opened from the closed position shown in FIG. 1, in which the valve body 9 lies with a seal against the valve face, downwards in the direction along the filling element axis FA.

The liquid valve 8 subdivides the liquid channel 4 into a a first section 4.1, which is directly connected to the liquid line 5 upstream of the liquid valve 8 in the direction of flow of the filling material, and a second section 4.2, which is downstream of the liquid valve 8 in the direction of flow of the filling material. The second section 4.2 creates clearance for the movement of the valve body 9 and is connected, via an adjacent third section 4.3 of the liquid channel 4, to the discharge opening 6.

In the third section 4.3, the cross-section of which is less than that of the second section 4.2, there is formed a gas barrier 10. After liquid valve 8 closes, the gas barrier 10 prevents filling material from continuing to flow or drip out of the gas barrier 10 and hence out of the second section 4.2, which is still full of filling material. The transition between the second and third sections 4.2 and 4.3 is executed without any steps on the inner surface of liquid channel 4.

In the depicted embodiment, the gas barrier 10 forms an annular flow channel that concentrically surrounds the filling element axis FA and that has a constant or essentially constant cross-section over its entire axial length. The axial length of this flow channel corresponds to the axial length of the third section 4.3 and is several times greater than the effective cross-section of the annular flow channel of the gas barrier 10.

In the depicted embodiment, the annular flow channel of the gas barrier 10 is formed by a rod-shaped element 11 that lies coaxial with the filling element axis FA. The rod-shaped element 11 reaches from the second section 4.2 into the third section 4.3 and extends over the entire axial length of the third section 4.3 in such a way that the circular-cylindrical outer surface of the rod-shaped element 11 is at a distance from the likewise circular-cylindrical inner surface of the third section 4.3. This distance forms the annular flow channel.

Corresponding to the cross-section of the annular flow channel, the radial distance between the outer surface of the rod-shaped element 11 and the inner surface of the third section 4.3 is several times less than the axial length of the third section 4.3 or of the gas barrier 10. The distance between the outer surface of the rod-shaped element 11 and the inner surface of the third section 4.3 is, for example, approximately 3% to 10% of the axial length of the gas barrier 10, with the exact value being matched to the filling material. For example, for example, the value can depend on the viscosity of the liquid filling material and/or the extent any presence of solid constituents in the filling material.

In the depicted embodiment, section 4.1 and the rod-shaped element 11 each exhibit a constant cross-section over the entire axial length of the gas barrier 10.

In the depicted embodiment, the rod-shaped element 11 extends through the entire second section 4.2 and is connected, at its upper end, is connected to valve body 9. Alternatively, the rod-shaped element 11 is manufactured with it as a single piece.

The rod-shaped element 11, which protrudes with a sharply tapered lower end out of the discharge opening 6, is preferably provided on its outer surface with an especially smooth finish obtained by appropriate machining and/or coating. The same applies to the inner faces of the liquid channel 4, in particular in the region of the third section 4.3 and/or of the gas barrier 10.

The described configuration entirely avoids any surfaces, elements, or structures that are oriented square to the direction of flow of the liquid filling material in the filling material channel 4 in the region of the gas barrier 10, and in particular, in the region of the transition between the second section 4.2 and the gas barrier 10 and in the second section 4.2 itself. This is advantageous because such surfaces, elements, or structures are places where constituents of the filling material can build up, clogging gas barrier 10 and/or reducing its cross-section. This could build up and so lead to a narrowing of the flow cross-sections or to a complete blockage of the filling element 1.

The connection of the rod-shaped element 11 with the valve body 9 has an additional advantage. During the movement of the valve body 9, and, in particular, during the opening of the liquid valve 8, the rod-shaped element 11 is also moved downwards. As a result, any solids that may have become lodged in the gas barrier 10 are loosened and/or dislodged towards the discharge opening 6 and are entrained by the filling material flowing to the bottle 2 through the open liquid valve 8.

The space 7 is used for purging the filling element 1 during a CIP cleaning and/or disinfection of the filling system during which the annular lower housing part 3.3 is closed on its open underside by a sealing or purging cap (not shown). A line 12 for feeding and/or extracting the cleaning and/or disinfection medium opens out into the space 7.

Figure 2:
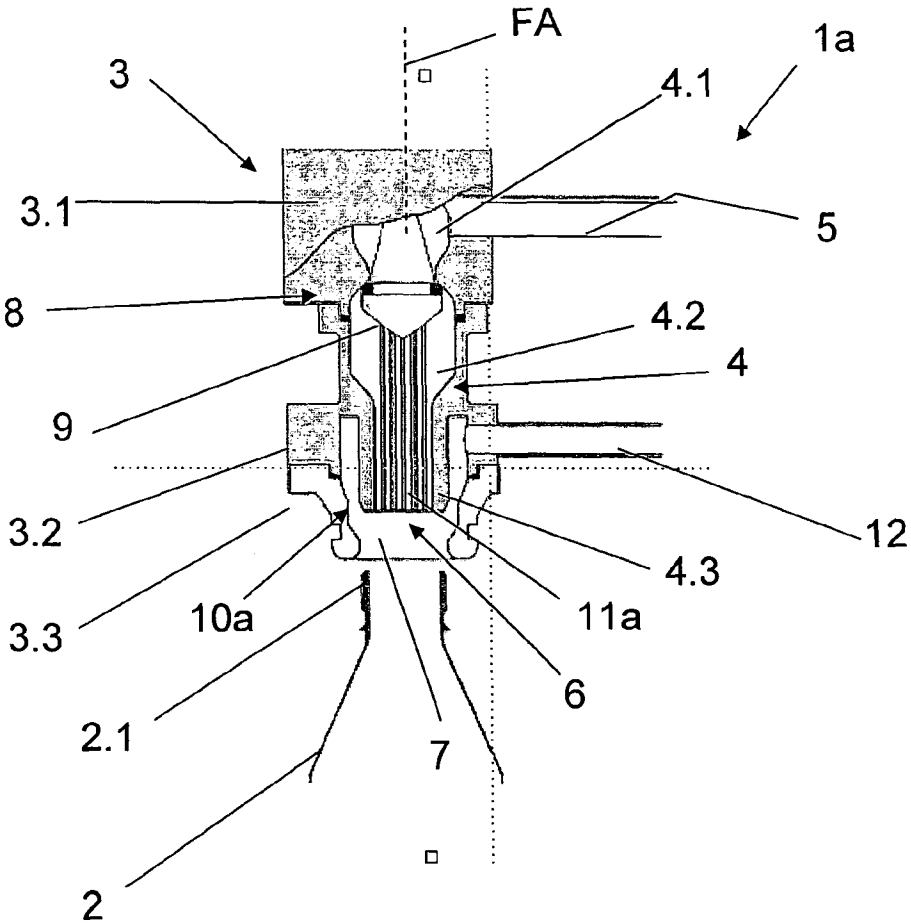
FIG. 2 shows an alternative embodiment of the filling element of FIG. 1.

FIG. 2 shows, as a further embodiment, a filling element 1*a* that, in essence, only differs from the filling element 1 in that the gas barrier 10*a* is formed by a plurality or bundle of rod-shaped elements 11*a* that extend in the direction of the filling element axis FA inside section 4.3 of liquid channel 4.

The rod-shaped elements 11*a*, which in the depicted embodiment are again configured as having a circular-cylindrical cross-section area and which each have a constant cross-section over their entire length, are spaced apart from one another so that the flow channels of the gas barrier 10*a* are obtained not just between the rod-shaped elements but also between the bundle of rod-shaped elements 11*a* and the inner surface of the third section 4.3.

The size of the cross-section area of the flow channels is again selected based on, for example, the viscosity of the liquid fraction of the filling material and/or of the extent of solid constituents in the filling material so that after the liquid valve 8 closes, the liquid filling material does not continue to flow or drip from the gas barrier 10*a* and from the second section 4.2 of the filling element 1*a*, which is still filled with filling material.

The rod-shaped elements 11*a* are attached by their upper end to the underside of the valve body 9 facing the discharge opening 6 and extend through the entire second section 4.2. In the depicted embodiment, they possess an axial length such that their lower ends are level with the discharge opening 6 when the liquid valve 8 is closed.

This embodiment also has the advantage of avoiding elements, surfaces, or structures that are oriented square to the direction of flow of the filling material in the liquid channel 4 and on which solid constituents of the filling material could become lodged, a condition that can ultimately lead to a narrowing of the flow cross-sections and/or to a complete blockage of filling element 1*a*.

With this embodiment the outer surfaces of the rod-shaped elements 11*a* and the inner surfaces of liquid channel 4, at least in third section 4.3, also have a particularly smooth finish obtained by appropriate surface machining and/or coating. Through the attaching of the rod-shaped elements 11*a* to the valve body 9, the filling element 1*a* likewise also has the further advantage that any constituents sticking in the gas barrier 10*a* are moved together with the rod-shaped elements 11*a* towards the discharge opening 6 when the liquid valve 8 opens, allowing these constituents to be easily removed from the gas barrier 10*a* with the liquid filling material.

Figure 3:
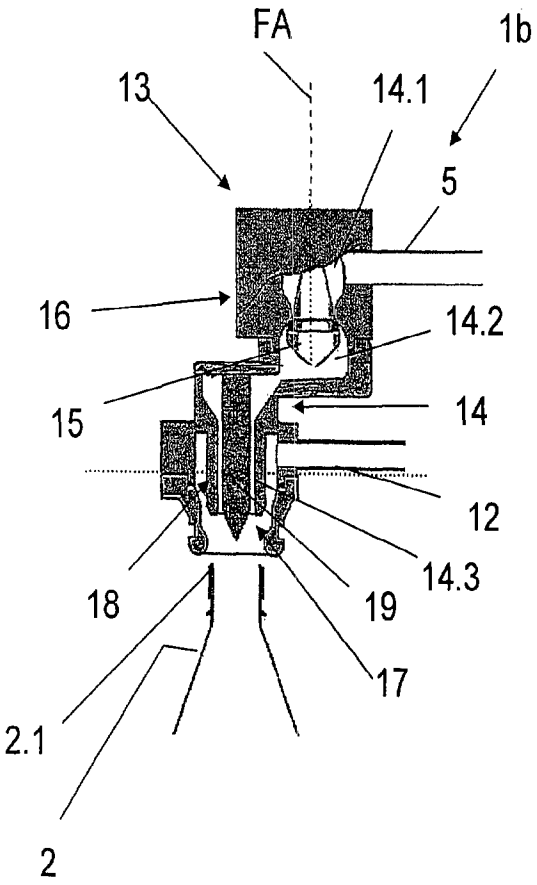
FIG. 3 shows a simplified partial view of a filling element.

FIG. 3 shows a simplified partial view of a filling element 1*b* that, in a filling element housing 13, has a liquid channel 14 and a liquid valve 16 formed by a valve stem with a valve body 15. In the direction of flow of the filling material, the liquid channel 14 forms upstream of the liquid valve a first section 14.1 which corresponds to the first section 4.1 and that is connected to the filling machine's container or tank, which feeds the filling material through the filling material line 5. A second section 14.2, which comes after the liquid valve 16 in the direction of flow of the filling material, and which corresponds to the second section 4.2, is connected to the discharge opening 17 in FIG. 3, which is formed by a third section 14.3 that corresponds to the third section 4.3 and through which the liquid filling material flows through the bottle mouth 2.1 into the bottle 2 during the filling process when the liquid valve 16 is open.

The third section 14.3, which has a constant cross-section over its entire axial length, is configured as gas barrier 18. In particular, starting from the second section 14.2, a rod-shaped element 19, which reaches into the third section 14.3, and which, in the depicted embodiment, possesses a constant cross-section over its entire axial length, is oriented with its axis parallel to the filling element axis FA and is attached in the interior of the second section 14.2 by an end thereof that is furthest from the discharge opening 17. The outside diameter of the rod-shaped element 19, which is, for example, circular-cylindrical on its outer surface, is somewhat less than the cross-section of the third section 14.3 so that the gas barrier 18 again presents an annular flow channel. Surfaces, regions, or structures that are oriented square to the direction of flow of the filling material and on which solid or more solid constituents of the filling material could become lodged thereby causing a narrowing of the flow cross-section or a complete blockage of filling element 1*b* are avoided inside the second section 14.2 at the transition between the second section 14.2 and the gas barrier 18 and also inside the gas barrier 18.

The filling element 1*b* differs from the filling elements 1 and 1*a* essentially in that a rod-shaped element 19 forming the gas barrier 18 is fixed to the filling element housing 13, i.e. it does not move together with the valve body 15 of the liquid valve 16.

Figure 4:
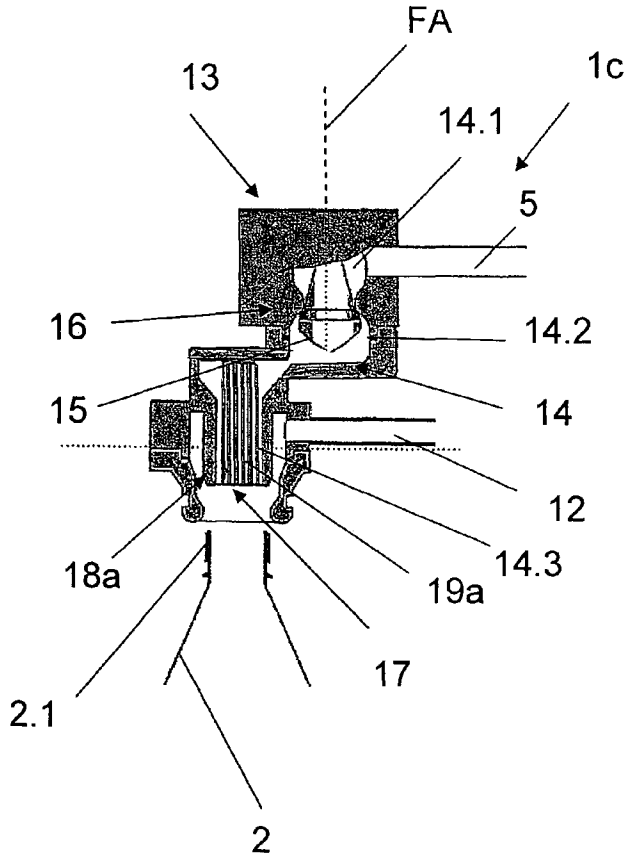
FIG. 4 shows an alternative embodiment of the filling element shown in FIG. 3.

FIG. 4 shows, as a further embodiment, a filling element 1*c* that differs from the filling element 1*b* in that a gas barrier 18*a* is formed by a plurality or bundle of rod-shaped elements 19*a* that in the depicted embodiment presents a constant cross-section over their axial length and whose axes are oriented in an axial direction parallel to the filling element axis FA. The rod-shaped elements 19*a*, which are held with their upper ends on the filling element housing 13, and which, with their lower ends, extend through the third section 14.3 as far as the discharge opening 17, are spaced apart from one another radially so that a plurality of flow channels forming the gas barrier 18*a* are formed between these elements as well as between the bundle of elements 19*a* and the inner surface of the third section 14.3. The cross-section of these channels is in turn adapted to the nature/viscosity and/or the solids content of the liquid filling material so that when the liquid valve 16 is closed, filling material is prevented from continuing to flow or drip out of the gas barrier 18*a* and out of the second section 14.2, which is still filled with filling material.

Whereas in the case of the filling elements 1 and 1*a*, the discharge opening 6 is disposed on the same axis as the filling element axis FA, the discharge opening 17 of the filling elements 1*b* and 1*c* is radially offset relative to the filling element axis FA.

The invention has been described hereinbefore by reference to embodiments. It goes without saying that numerous variations as well as modifications are possible without departing from the inventive concept underlying the invention.

For example it has been assumed above that the cross-sections of rod-shaped elements 11, 11*a*, 19 and 19*a* as well as that of the second and third sections 4.3 and 14.3 are constant over their entire length. Embodiments are also possible however in which the cross-sections change, albeit continuously and/or without steps, over the length of the rod-shaped elements and/or sections so that surface regions or structures on which solid constituents could become lodged are avoided inside the respective gas barrier 10, 10*a*, 18, 18*a*.

Having described the invention, and a preferred embodiment thereof, what is claimed as new and secured by Letters Patent is:

1. An apparatus for filling containers with a liquid filling material, said apparatus comprising a filling element for a filling machine, said filling element comprising a filling element housing having a liquid channel configured therein, said liquid channel forming at least one discharge opening for said liquid filling material, said liquid channel being connected to a source of said liquid filling material, a liquid valve disposed along said liquid channel for controlled discharge of said filling material through a discharge opening thereof, and a gas barrier that, when said liquid valve is closed, prevents said filling material from continuing to flow or drip from a first section of said liquid channel, said first section being disposed downstream from said liquid valve, said gas barrier being formed from at least one rod-shaped element that extends from said first section into a one of a second section of said liquid channel and said discharge opening, said gas barrier forming a flow channel having a reduced cross-section in said second section of said liquid channel, said reduced cross-section being a cross section that is not occupied by said rod-shaped element and that forms said flow channel of said gas barrier, wherein said reduced cross-section is between 3% and 10% of the cross-section of said first section.

2. The apparatus of claim 1, wherein said gas barrier is disposed in said second section of said liquid channel, said second section being disposed downstream from said first section in the direction of flow of said liquid filling material.

3. The apparatus of claim 1, wherein said gas barrier is disposed at said discharge opening.

4. The apparatus of claim 1, wherein said flow channel of said gas barrier has a cross sectional area that is less than a cross sectional area of said first section of said liquid channel.

5. The apparatus of claim 1, wherein said flow channel of said gas barrier has a length that is less than an axial length of said gas barrier.

6. The apparatus of claim 1, wherein said gas barrier is formed by a bundle of rod-shaped elements that extend inside said second section of said liquid channel.

7. The apparatus of claim 1, wherein said rod-shaped elements all have the same axial length.

8. The apparatus of claim 1, wherein said gas barrier is formed by a bundle of rod-shaped elements that extend inside said discharge opening.

9. The apparatus of claim 1, wherein said gas barrier is formed by a single rod-shaped element that extends inside said second section of said liquid channel.

10. The apparatus of claim 1, wherein said gas barrier is formed by a single rod-shaped element that extends inside said discharge opening.

11. The apparatus of claim 1, wherein said at least one rod-shaped element extends through said first section of said liquid channel as far as a surface of said first section of said liquid channel, said surface being disposed opposite said discharge opening.

12. The apparatus of claim 11, wherein said at least one rod-shaped element extends through said first section of said liquid channel as far as a valve body of said liquid valve.

13. The apparatus of claim 11, wherein said at least one rod-shaped element is connected to a valve body of said liquid valve.

14. The apparatus of claim 11, wherein the at least one rod-shaped element extends as far as a wall delimiting said liquid channel.

15. The apparatus of claim 1, wherein said flow channel of said gas barrier is formed between said at least one rod-shaped element and an inner surface of said second section.

16. The apparatus of claim 1, wherein said gas barrier is formed by a bundle of rod-shaped elements that extend inside said second section of said liquid channel, said rod-shaped elements being spaced apart from each other to form flow channels of said gas barrier between said rod-shaped elements.

17. The apparatus of claim 1, wherein said at least one rod-shaped element has an envelope shaped like a circular cylinder.

18. The apparatus of claim 1, wherein said at least one rod-shaped element is finished with a smooth surface.

19. The apparatus of claim 1, wherein said second section of said liquid channel comprises a wall that is finished with a smooth surface.

20. The apparatus of claim 1, wherein said at least one rod-shaped element protrudes from said discharge opening.

21. The apparatus of claim 1, wherein a tapering end of said at least one rod-shaped element protrudes from said discharge opening.

22. The apparatus of claim 1, wherein a free end of said at least one rod-shaped element is arranged to be level with said discharge opening when said liquid valve is closed.

23. The apparatus of claim 1, wherein said flow channel of said gas barrier has a cross sectional area that is less than said second section of said liquid channel.

* * * * *